US007252196B1

(12) United States Patent
Koefelda et al.

(10) Patent No.: US 7,252,196 B1
(45) Date of Patent: Aug. 7, 2007

(54) CRATE FOR BOTTLES AND OTHER CONTAINERS

(75) Inventors: Gerald R. Koefelda, Seal Beach, CA (US); Donald L. Bell, Redondo Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 463 days.

(21) Appl. No.: 09/710,516

(22) Filed: Nov. 10, 2000

(51) Int. Cl.
*B65D 21/036* (2006.01)

(52) U.S. Cl. ..... 206/511; 220/516

(58) Field of Classification Search ..... 220/507, 220/510, 513, 514, 515, 516, 518, 519; 206/508, 206/509, 511, 203, 427, 561
See application file for complete search history.

(56) References Cited

U.S. PATENT DOCUMENTS 2,928,530 A * 3/1960 Sauey ..... 206/3
3,998,327 A * 12/1976 Box
D257,528 S 11/1980 Cherry
4,391,386 A 7/1983 Moret
D271,343 S 11/1983 Miller
4,585,137 A * 4/1986 Poutiainen
4,620,644 A 11/1986 Miller
4,625,908 A * 12/1986 Emery
4,685,567 A 8/1987 Webb
4,700,836 A * 10/1987 Hammett
D306,264 S 2/1990 Malmanger
D326,775 S 6/1992 Skillius
5,328,048 A 7/1994 Stein
5,335,814 A * 8/1994 Hepp
5,351,814 A 10/1994 Apps
5,673,791 A 10/1997 Jamison
5,769,230 A * 6/1998 Koefelda ..... 206/508
D408,142 S 4/1999 Song
5,975,300 A 11/1999 Gale

* cited by examiner

*Primary Examiner*—Stephen J. Castellano

(57) ABSTRACT

A crate adapted to store therein a container having a central bottle portion having label disposed thereon and a lower portion disposed below the label. The crate includes a floor member having an upper surface with a plurality of container support portions disposed thereon. The crate also includes a first pair of opposed upstanding side walls and a second pair of opposed upstanding side walls attached to a periphery of the floor member and defining a compartment area with the floor member. The crate further includes at least one container standoff member which is disposed within the compartment area proximate the floor member and is associated with a corresponding container support portion for defining at least one container receiving area. The at least one standoff member has a relatively short height corresponding generally to the lower portion of the container, the standoff member adapted to engage the lower portion of the container and oriented such that it does not contact the label of the container.

21 Claims, 17 Drawing Sheets

LID CAPTURE AREA

BOTTLE STANDOFF

CRATE FOR BOTTLES AND OTHER CONTAINERS

TECHNICAL FIELD

This invention relates to a crate for transporting and storing bottles and other containers.

BACKGROUND ART

Divided crates are used in industry today to transport a variety of goods. Such divided crates are commonly formed of corrugated cardboard, plastic, and wood and have an open compartment into which the goods are placed. When transporting bottles or the like, typical crates do not allow the bottles to maintain an upright or aligned configuration but instead allow for play. Such alignment is desirable particularly when crates are stacked upon one another. For example, typically, a single plastic beverage bottle can support the weight of many bottles of the same size filled with beverage if the bottle is standing upright on a flat, horizontal surface and the weight of the other bottles is applied to the closure of the single bottle and is directed substantially vertically along the symmetric axis. However, if a compressive load is applied to a conventional plastic beverage bottle along a direction other than the symmetry axis of the bottle, the bottle may buckle. This tendency of conventional plastic bottles to give way under off-axis compressive loads is particularly pronounced for large capacity bottles, such as the two-liter bottle widely used for marketing soft drinks.

In addition, crates are frequently stacked on pallets which can be lifted and moved about by lift trucks. The stacks of crates on the pallets must therefore be particularly stable in order to remain standing. A technique for interconnecting stacks of empty cases, called "cross-stacking," is often used to improve the stability of empty cases loaded on a warehouse pallet. Cross-stacking generally involves stacking rectangular bottle cases to build up a layered structure, with each layer having cases oriented parallel to each other and with the adjacent layers being oriented at right angles to each other. Thus, since the adjacent layers are perpendicular, each case in the cross-stacked layer rests on at least two cases in the layer below. As a result, the cases of the cross-stacked layer tend to keep the cases on which they rest from moving apart from each other. The cross-stacked layers therefore stabilize the stacked structure.

Bottles can tilt away from vertical alignment upon stacking if conventional partitioned cases having low side walls are used to contain the bottles. Tilted bottles in the lower cases of a stack may cause the stack to fall. Even absent buckling, the tendency of bottles to tilt in conventional low-sided cases is not desirable. Tilting generally places an undesirably low limit on the number of tiers in a stack since the tilting of bottles in one case and may lead to instability.

A competing concern for storing and transporting beverage bottles is protecting the bottle label. Most beverage bottles sold today, whether glass or plastic, have labels attached thereto, via adhesive or screened thereon. Because of the information the label provides, it is desirable that the label stay intact and fully attached to the bottle. Of course, the label provides the nature of the bottle's content as well as the brand name and associated trademarks and goodwill of the manufacturer, among other things. In many crates which have dividers and other walls adjacent the bottles, the bottle label may be subject to rubbing, wear, or other damage resulting from contact with the dividers or walls.

The prior art has attempted to keep the bottles in an upright orientation. For example, see U.S. Pat. No. 5,351,814, assigned to the assignee of the present invention and incorporated by reference herein. While this patent discloses a case which maintains bottles in an upright position, it does not resolve the possibility that the labels may be subjected to wear from the case dividers and walls.

Therefore, there exists a need for an improved crate for storing and transporting containers such as bottles, whereby the containers are stable, upright, and do not tend to tilt from vertical. Also, the crate should be capable of stacking and cross-stacking, and the bottle labels should be protected from rubbing, wear, and other damages resulting from contact with the crate's dividers and/or walls,

DISCLOSURE OF INVENTION

It is an object according to the present invention to provide an improved crate for storing and transporting containers such as bottles in which the containers are maintained in a stable and upright orientation.

It is another object according to the present invention to provide an improved crate for holding containers which is capable of stacking and cross-stacking with other containers.

It is still another object according to the present invention to provide an improved crate for holding containers having labels, such as bottles, in which the labels are protected from rubbing, wear, and other damage from the crate's dividers and/or walls.

In accordance with the teachings of the present invention, provided is a crate for holding beverage containers including a bottom panel, and a first pair of opposed side walls and a second pair of opposed side walls which are attached to the periphery of the bottom panel to define a compartment area. Further included is a plurality of divider members which extend longitudinally and transversely within the compartment area to define a plurality of container receiving pockets. The divider members include a plurality of standoff portions extending inwardly into each container receiving pocket for providing stability to the beverage containers. In one embodiment, the crate includes a lid member which is pivotably attached at least one of the first and second pair of opposed side walls and has a lid inner surface with a lid capture area formed therein. Each lid capture area corresponds to each container retention area, and the lid capture area is appropriately sized to receive an upper portion of a respective container for providing alignment to the container. The lid member is orientable between a closed position and an open position. The lid member also has an outer surface with a plurality of projections extending therefrom, such that when the lid member is in the closed position and a second crate is stacked thereupon, each of the plurality of projections on the outer surface is received within a corresponding projection receiving area in the bottom panel of the second crate for providing a more stable stacking configuration.

In one embodiment, the plurality of standoff portions have a mating surface for engaging the container which is preferably curved for mating with a container having a cylindrical body portion. Also, the standoff portions have a height relatively shorter than the corresponding divider members. It is contemplated that each container receiving pocket has four standoff portions extending therein, one standoff portion per divider member. The standoff portion may also engage the bottom panel.

Another embodiment of the crate according to the present invention provides a crate for retaining containers having an upper container portion, and including a floor, and a first and second pair of opposed sidewalls which extend upwardly from the floor to define a compartment area having a plurality of container retention areas therein. At least one of the sidewalls has a lock opening formed therein. Also provided is a lid member which is pivotably attached at least one of the first and second pair of opposed side walls and is also movable between an open and closed position. The lid member has a lid inner surface which has a lid capture area corresponding to each container retention area. The lid capture area is sized to receive therein the upper container portion of a respective container for providing alignment to the container. The lid member further has at least one locking member attached thereto, such that, when the lid member is in the closed position, the locking member is received within the lock opening for securing the lid member.

As with the previous embodiment the crate may include a plurality of divider members which extend longitudinally and transversely within and across the compartment area in order to define the plurality of container retention areas. The divider members include a plurality of standoff portions which extend inwardly into each container retention area for providing stability to the containers.

In still another embodiment, provided is a crate for storing a container therein. The crate includes a floor member, and a first pair of opposed upstanding side walls and a second pair of opposed upstanding side walls which are attached to the floor member and define a compartment area therebetween. Also provided is a first pair of divider members and a second pair of divider members which extend generally perpendicular to each other within the compartment area to define at least one container storage areas. Further provided is a plurality of standoff members which are disposed within the at least one container storage area and which extend inwardly from the divider members for spacing the container from the divider members. In one embodiment, the first and second pairs of divider members extend longitudinally and transversely in the compartment area, respectively, to define the at least one container storage area. This crate may also include a lid member as described above.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
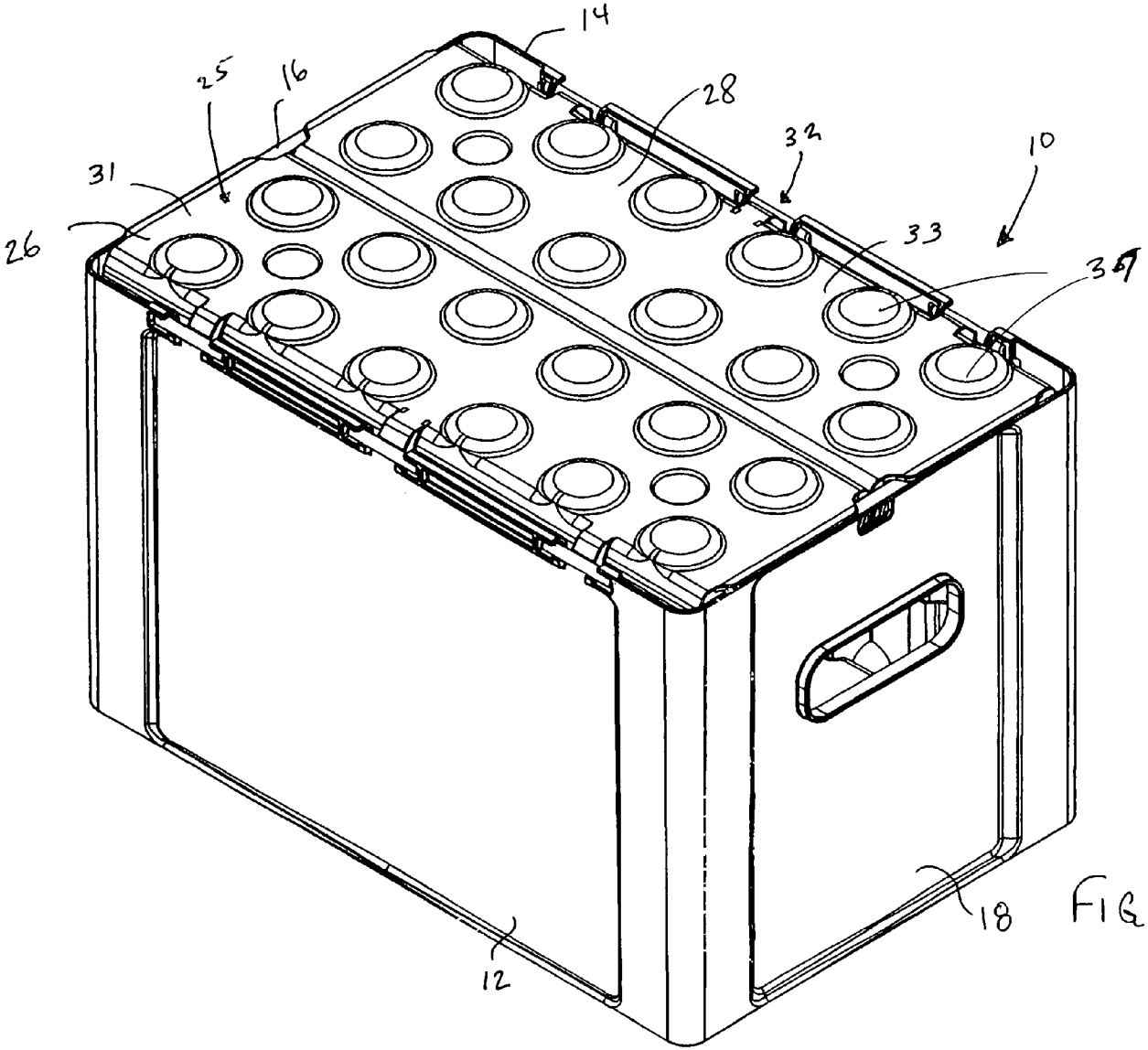
FIG. 1 is a perspective view of the container according to the present invention, having a lid in a closed position.
Figure 2:
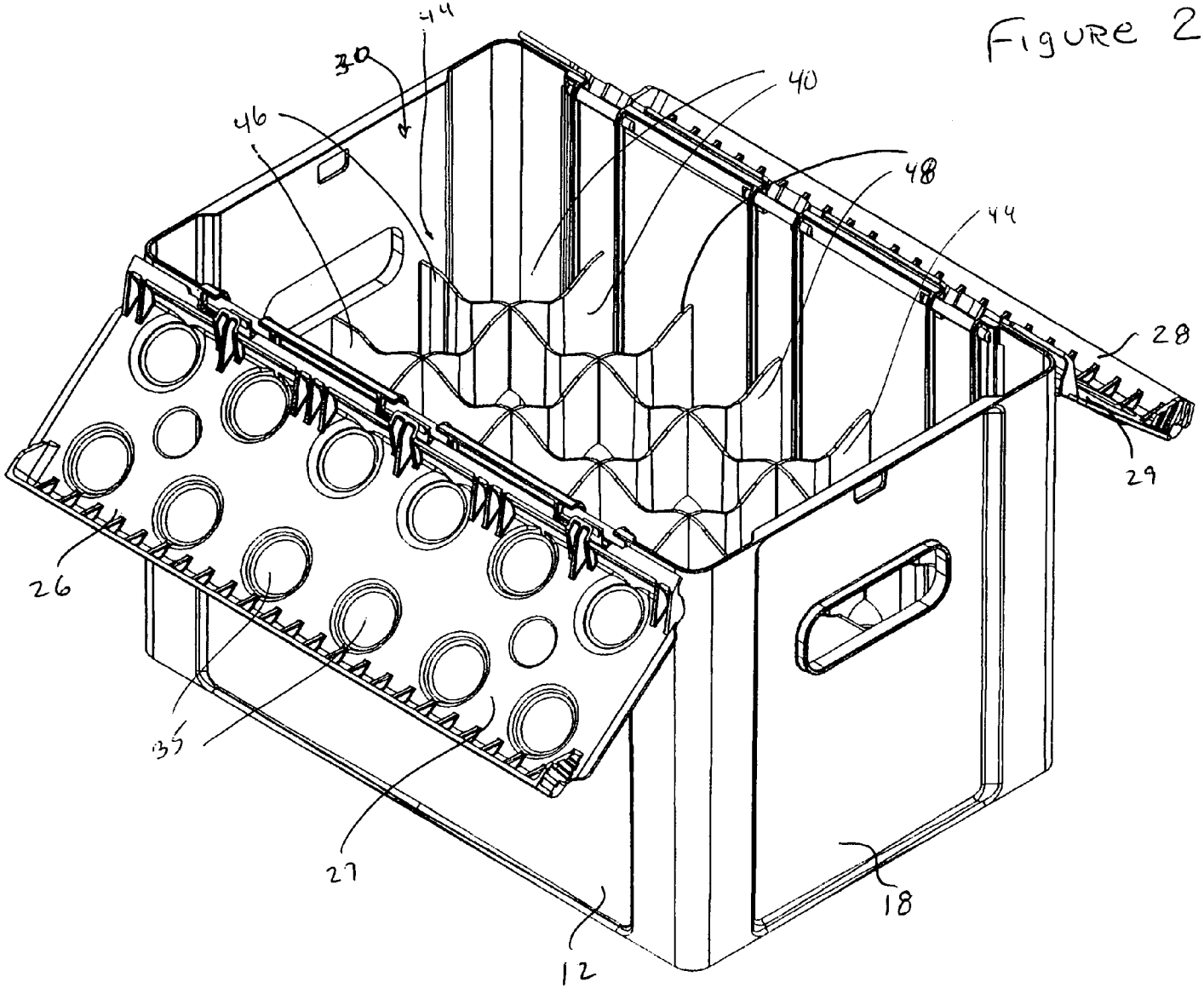
FIG. 2 is a perspective view of the container according to the present invention, with the lid in the open position.
Figure 3:
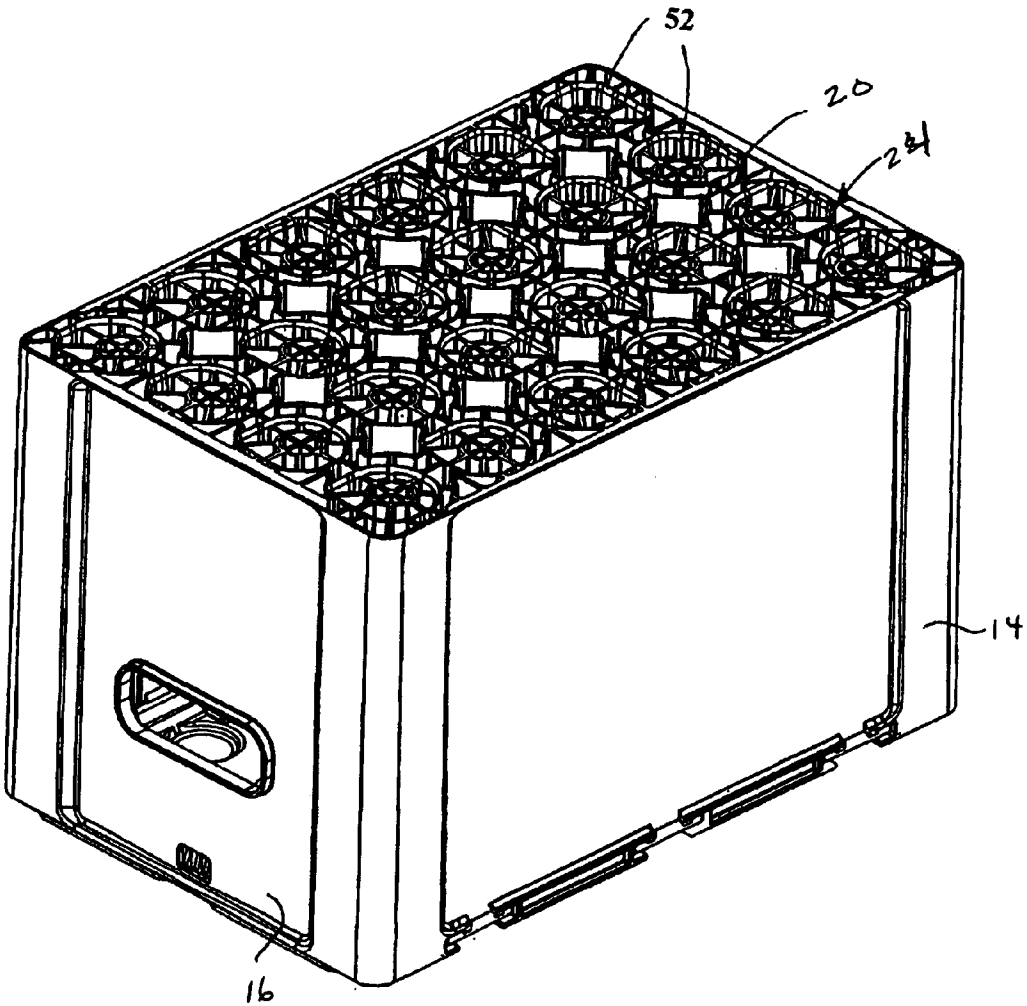
FIG. 3 is a bottom perspective view of the container of FIG. 1.
Figure 5:
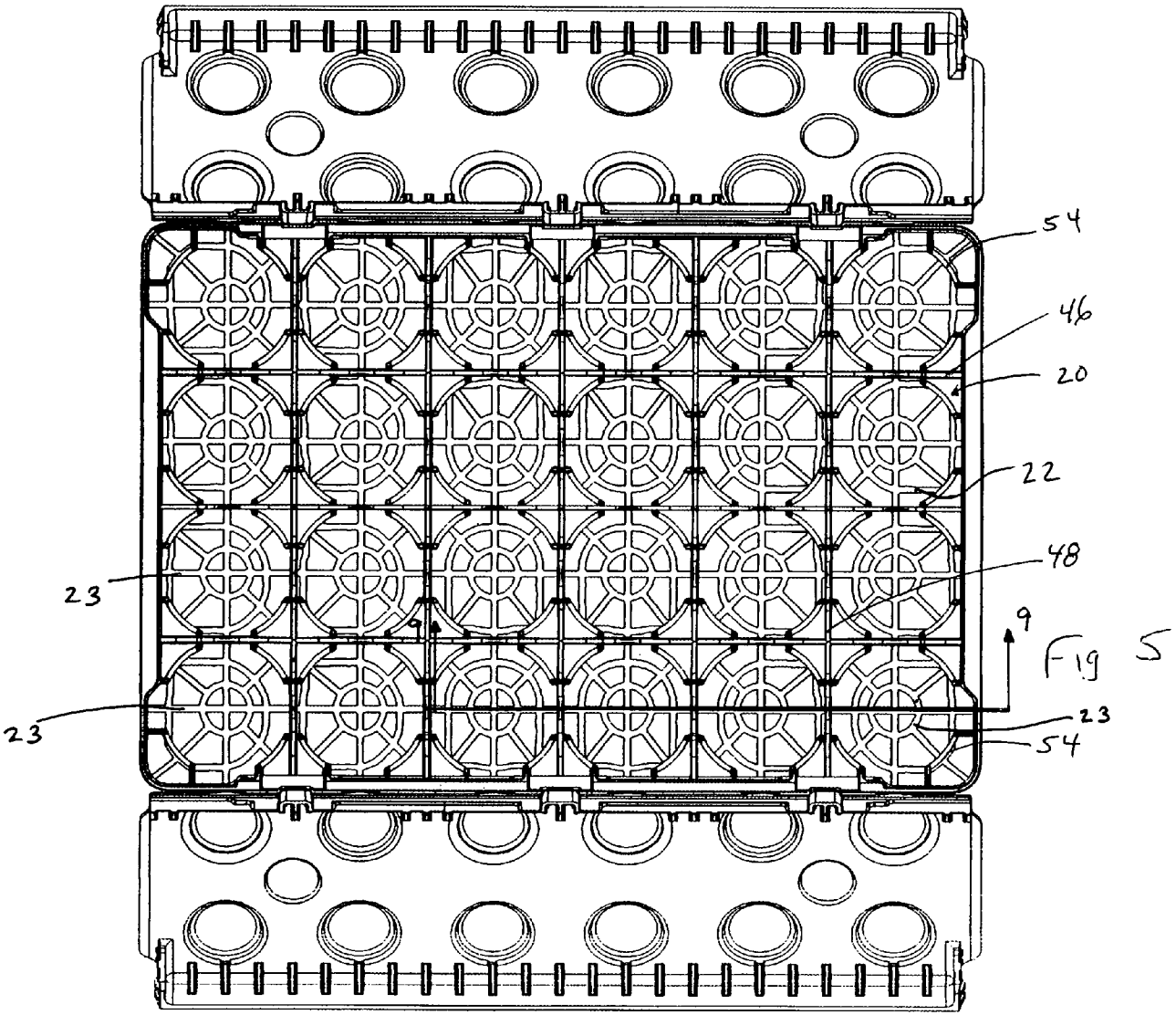
FIG. 5 is a top plan view of the container of FIG. 2, having an open lid.

With reference to FIGS. 1-3 and 9, illustrated therein is a crate 10 according to the present invention for storing and transporting containers 38, which are contemplated to be generally cylindrical containers, such as bottles. Crate 10 may also be referred to as a bottle case. Crate 10 is generally rectangular in shape and includes a first pair of opposed sidewalls 12, 14 and a second pair of opposed sidewalls 16, 18. Referring to FIGS. 3 and 5, crate 10 also includes a bottom panel 20 (floor) having an upper surface 22 which faces the interior of crate 10, and also includes a lower surface 24. Upper surface 22 includes a plurality of container support areas 23 upon which containers 38 are supported within crate 10. Walls 12, 14, 16, 18 and bottom panel 20 define a compartment 20 within crate 10. Crate 10 is generally symmetrical about its longitudinal and transverse centerlines. Crate 10 is preferably formed of a thermoplastic resin, such as polypropylene, via an injection molding process or other plastic molding process.

Compartment 30 of crate 10 is illustrated as rectangular in shape and capable of storing and transporting four rows of six bottles 38 each for a total of twenty-four bottles. However, it is fully contemplated and understood that the teachings according to the present invention may be applicable to a crate which is square, polygonal, or having any variety of shapes to which the teachings according to the present invention may be applied. Accordingly, it is also contemplated that such a crate may hold various quantities and sizes of bottles therein, in keeping with the teachings according to the present invention.

Figure 4:
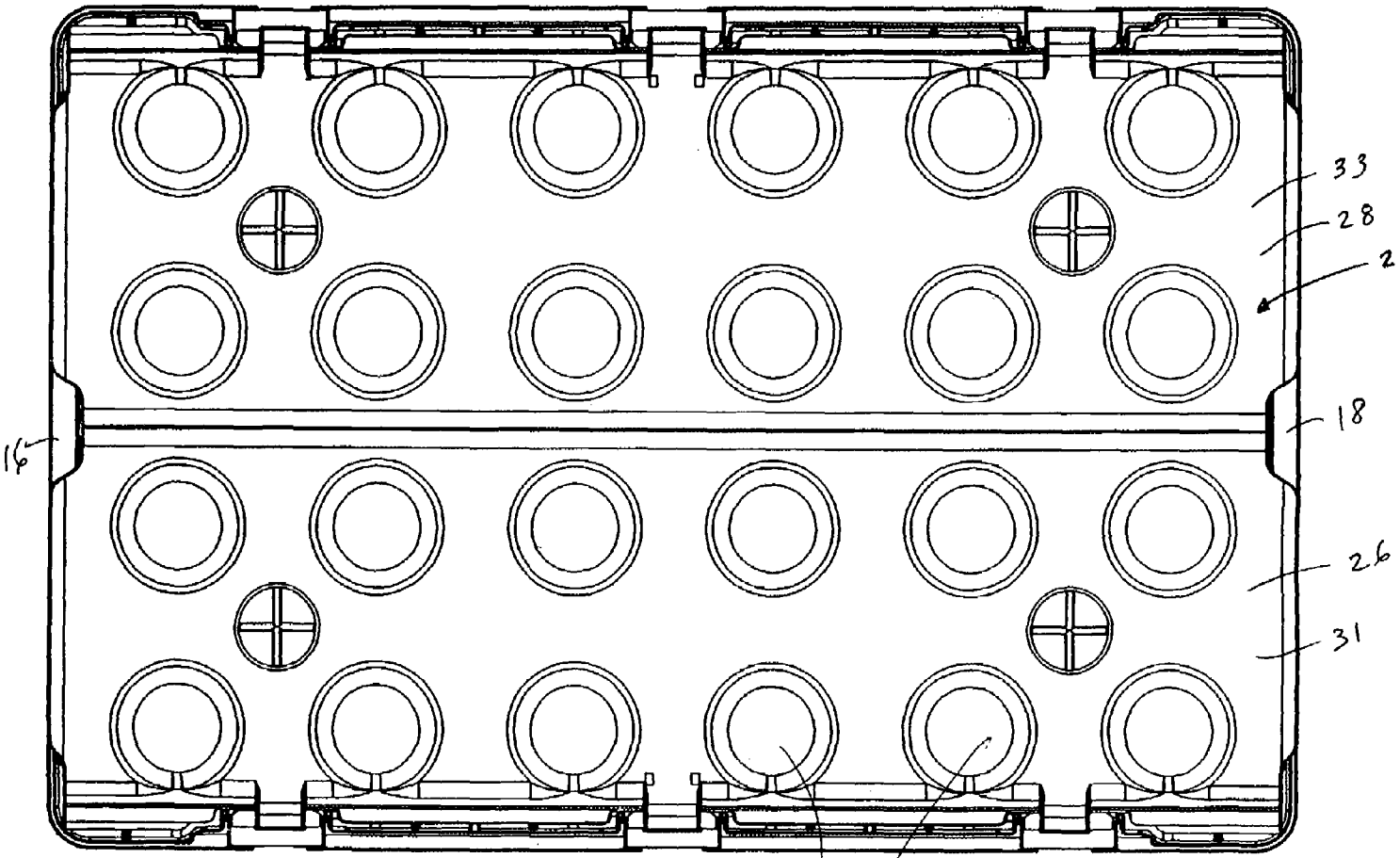
FIG. 4 is a top plan view of the container of FIG. 1.

In a preferred embodiment, crate 10 has a lid 25 which includes a first lid portion 26 (or member) and a second lid portion 28 (or member) which in FIG. 1 are shown in a closed position and in FIG. 2 are illustrated in an outwardly rotated and open position. Lid portions 26, 28 provide physical protection to the bottles or containers stored in crate 10, as well as protection from sunlight, ultraviolet rays and other environmental factors that may affect the containers or their contents. Lid portions 26 and 28 are each pivotally mounted to a corresponding sidewall 12 and 14, respectively. As shown in FIGS. 1 and 4, when lid portions 26, 28 are in the closed position, they each extend transversely across half of the crate width and meet along the longitudinal axis of crate 10. (See also FIGS. 13 and 15.) With reference to FIG. 2, when lid portions 26, 28 are in the open position, the storage compartment 30 of crate 10 is exposed and made accessible.

Figure 16:
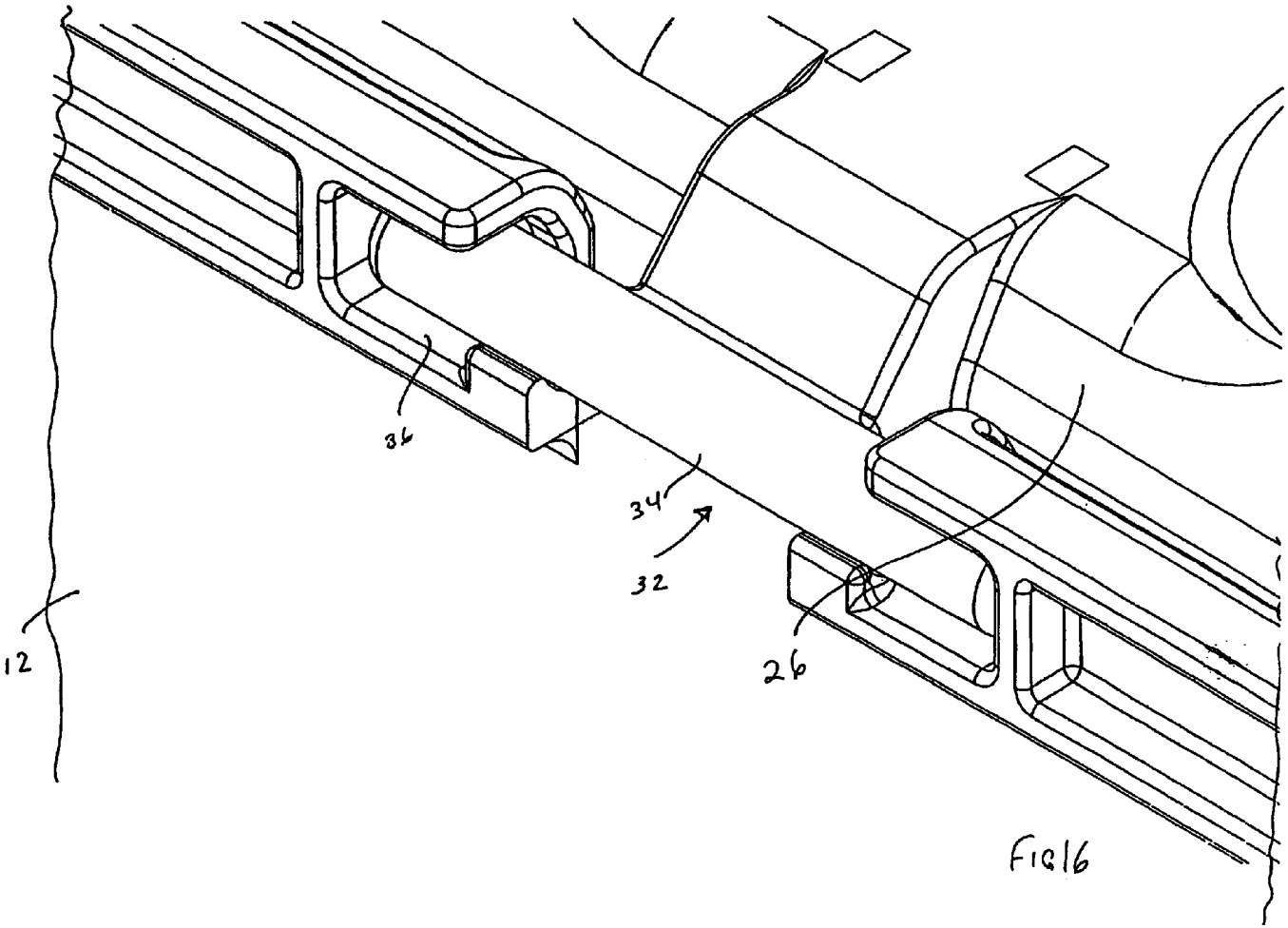
FIG. 16 is an enlarged perspective view showing a hinge portion of the lid according to the present invention.
Figure 19:
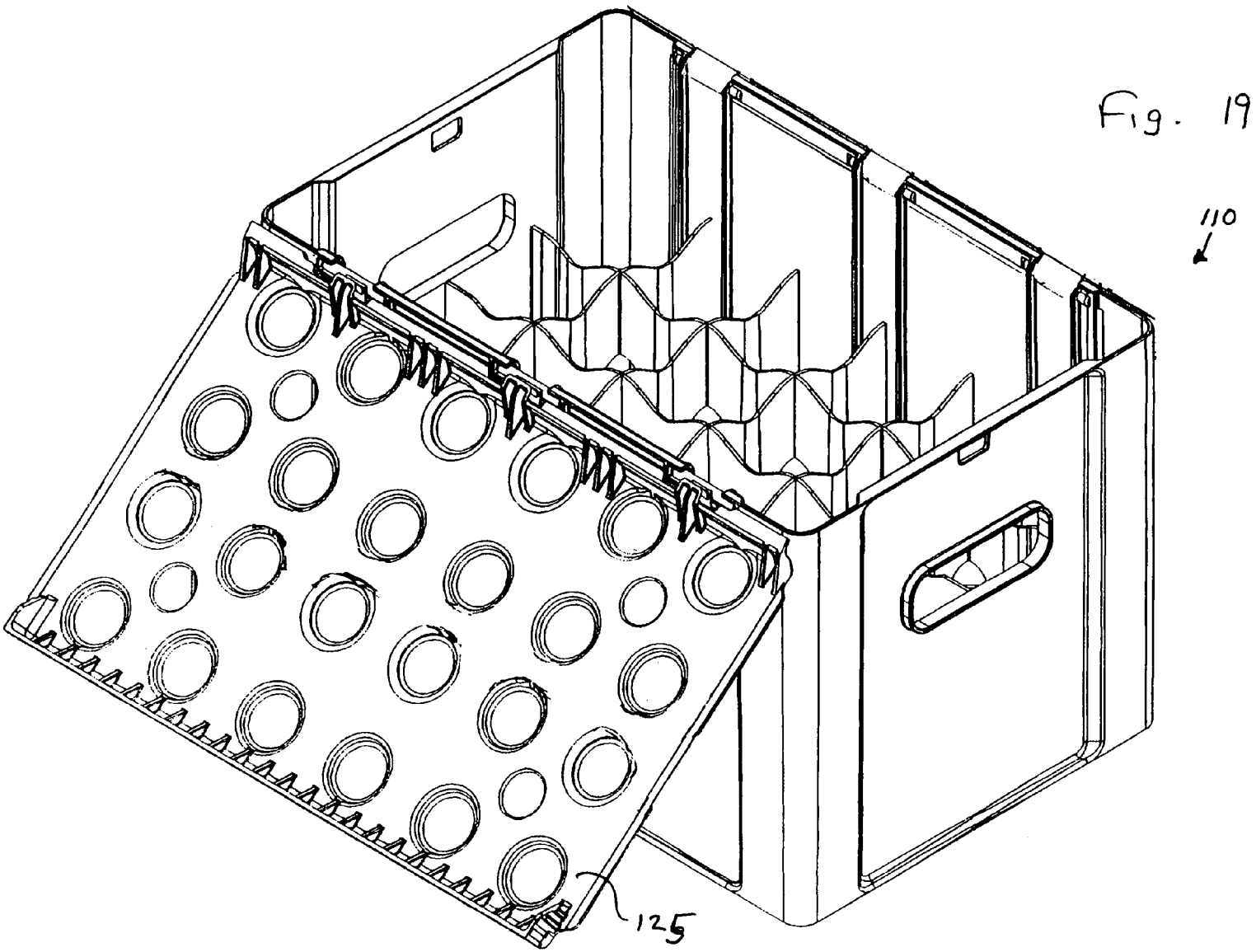
FIG. 19 is a perspective view of a crate according to the present invention having a single lid member.

As is further illustrated in FIGS. 1 and 2 and with particular reference to FIG. 16, lid portions 26, 28 are attached to sidewalls 12, 14, respectively, by way of hinge portions 32, which include one or more pivot members 34 attached to each lid portion 26, 28 and defining the rotational axis of the lid portion. Each pivot member 34 is disposed within a corresponding channel member 36 formed on the respective sidewalls 12, 14. Pivot members 34 are securely held within channel members 36 so that pivot members 34 do not become disengaged from channel members 36 during rotation of the corresponding lid portion 26, 28. Thus, lid portions 26, 28 are movable between an open position (FIG. 2) and a closed position (FIG. 1.) Note that in the alternative, the lid may be a single portion 126 disposed on container 110 (FIG. 19).

Figure 8:
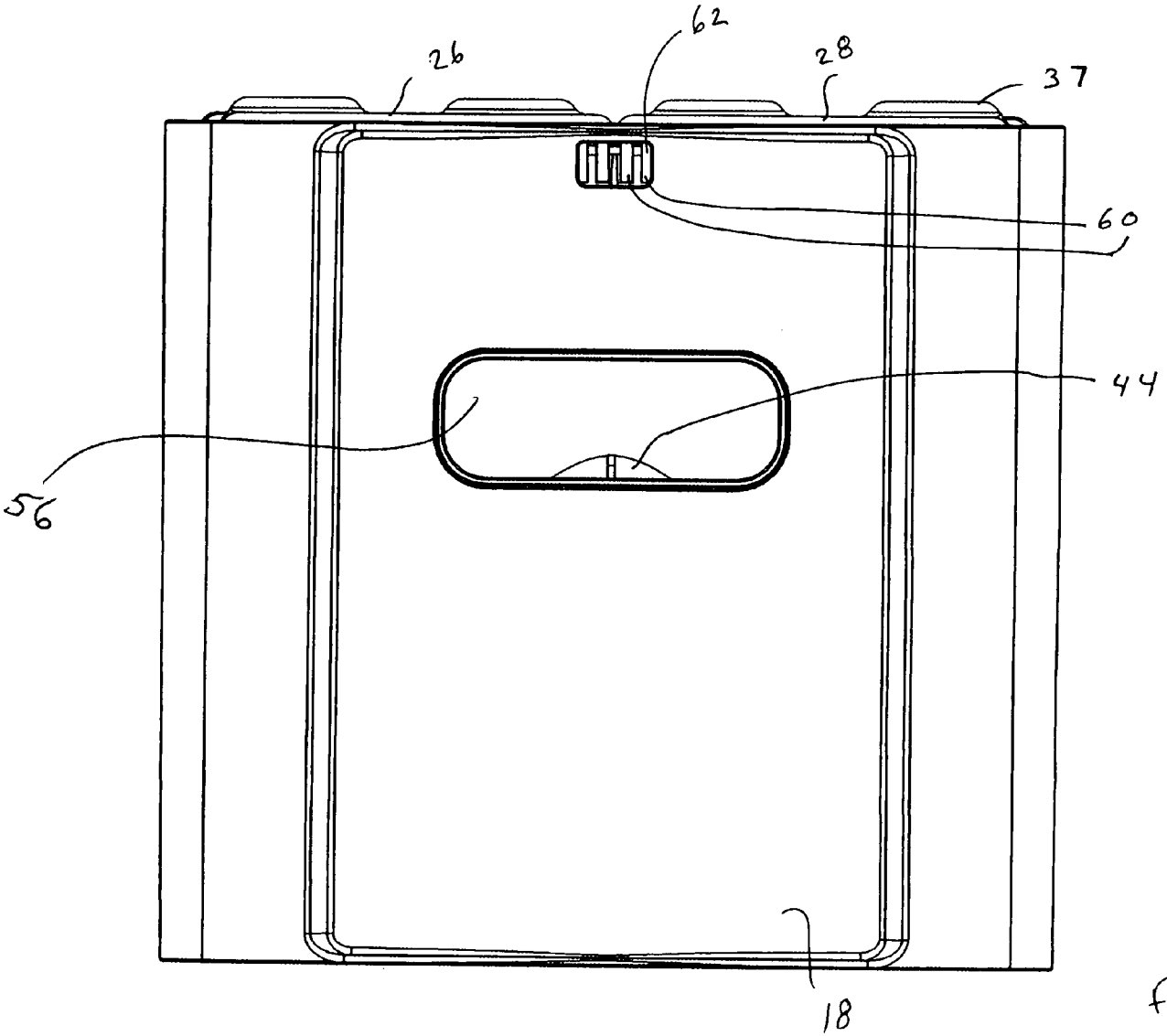
FIG. 8 is a left side elevational view of the container of FIG. 1 having a closed lid, the right side elevational view being a mirror image thereof.
Figure 10:
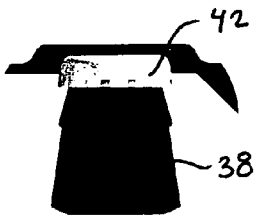
FIG. 10 is a cutaway elevational view showing the position of a bottle cap within the lid capture area.
Figure 9:
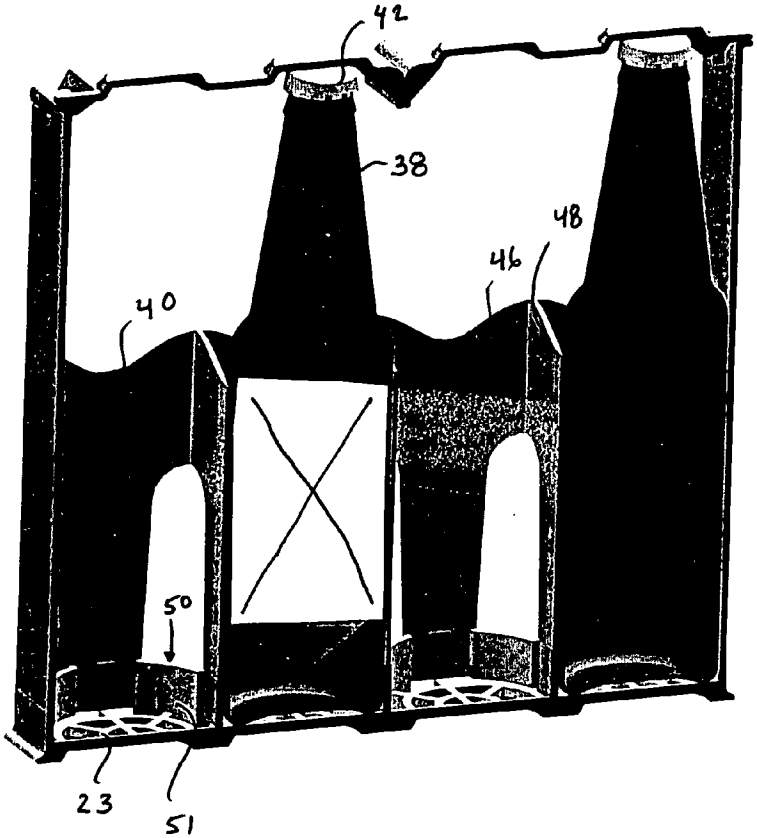
FIG. 9 is a cross-sectional view taken along line 9-9 of FIG. 5, illustrating the bottle placement and positioning within the container, particularly showing a closed lid.

With further reference to FIGS. 2 and 9-10, it is illustrated that crate 10 may store and transport a plurality of bottles 38, each received within an individual bottle retention area 40. Bottles 38 typically have a generally cylindrical body with a tapered neck portion and an upper cap portion (see FIGS. 9-10.) As mentioned above, while the bottles stored in crate 10 may be of various sizes and shapes, those illustrated are typical twelve-ounce beverage bottles, such as those which are commonly known to hold soft drinks, beer, juices or other types of beverages. Each lid portion 26, 28 has a plurality of cap receiving areas 35 (or lid capture areas) which as illustrated in FIGS. 1, 2, 7 and 8 are defined by recesses in the bottom surface 27, 29 of each lid portion for receiving the top of a bottle 38 therein. While bottle 38 is shown as having a cap 42 disposed thereon (FIGS. 9-10) such as when it is full, it is also contemplated that lid capture area 35 is also capable of receiving a bottle without a cap, for those situations when empty or uncapped bottles are stored and transported.

Figure 7:
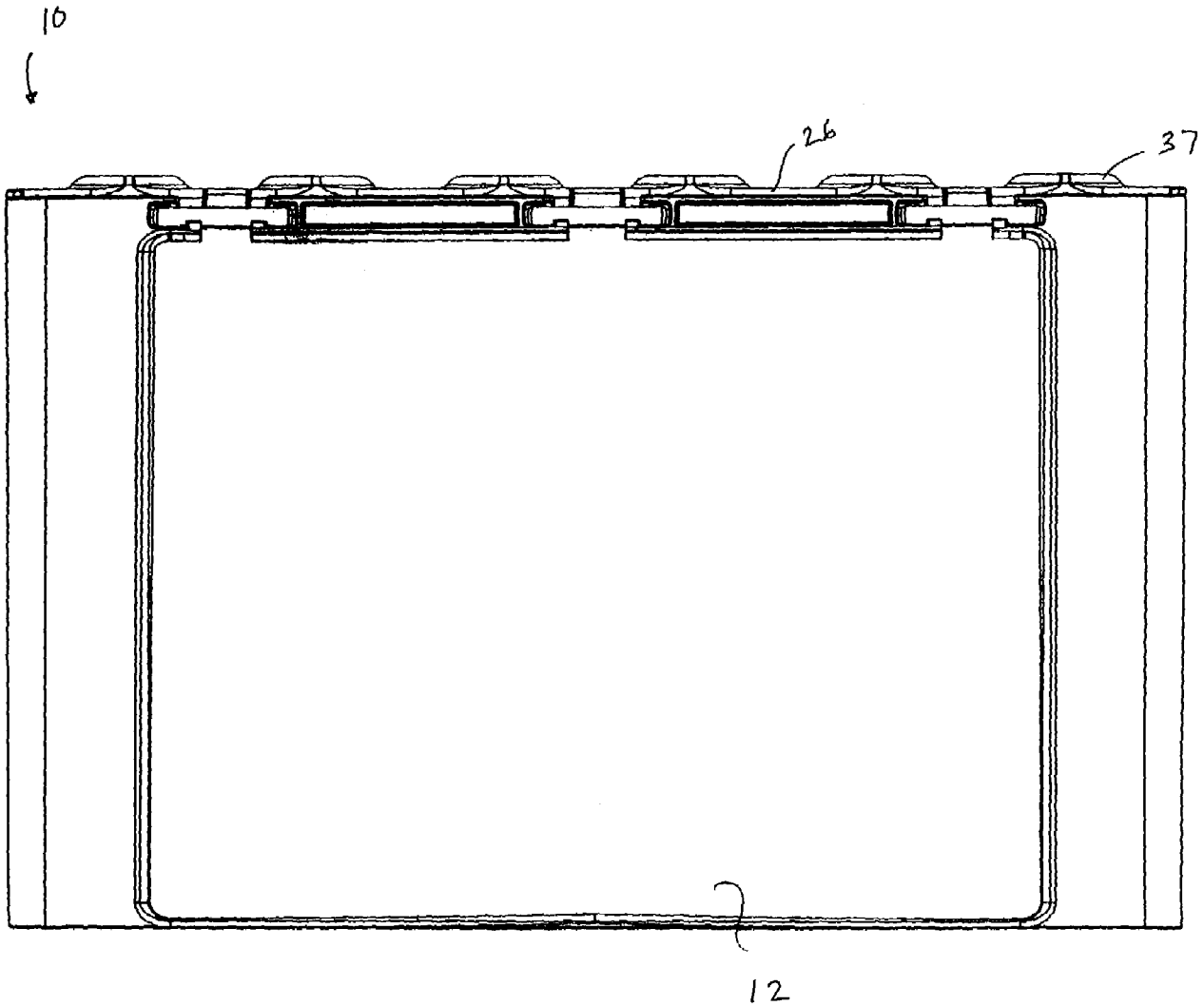
FIG. 7 is a front elevational view of the container according to the present invention with the lid closed, the rear elevational view being a mirror image thereof.
Figure 17:
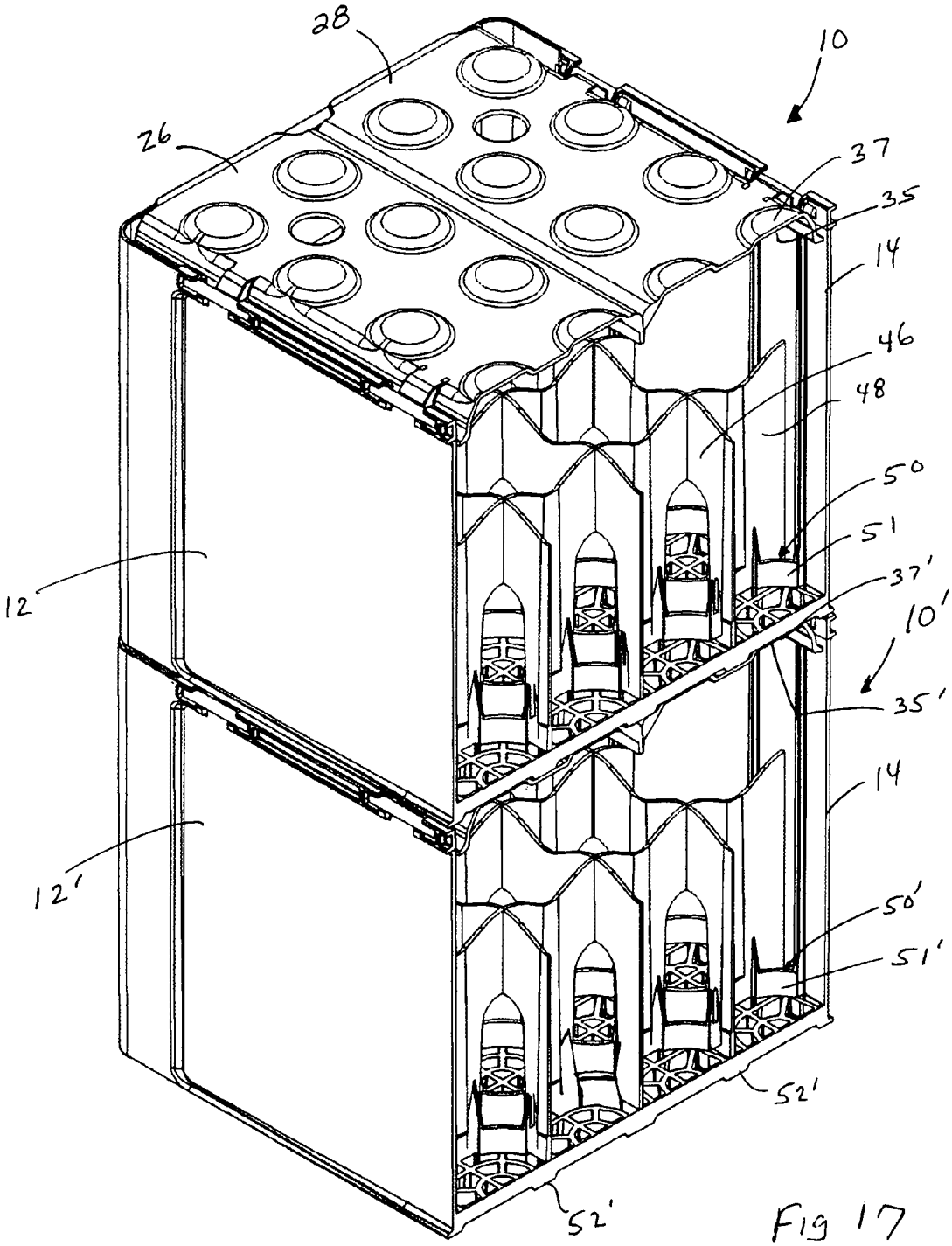
FIG. 17 is a perspective cross-sectional view of two crates according to the present invention in a stacked orientation, taken along the transverse center line of the containers.
Figure 18:
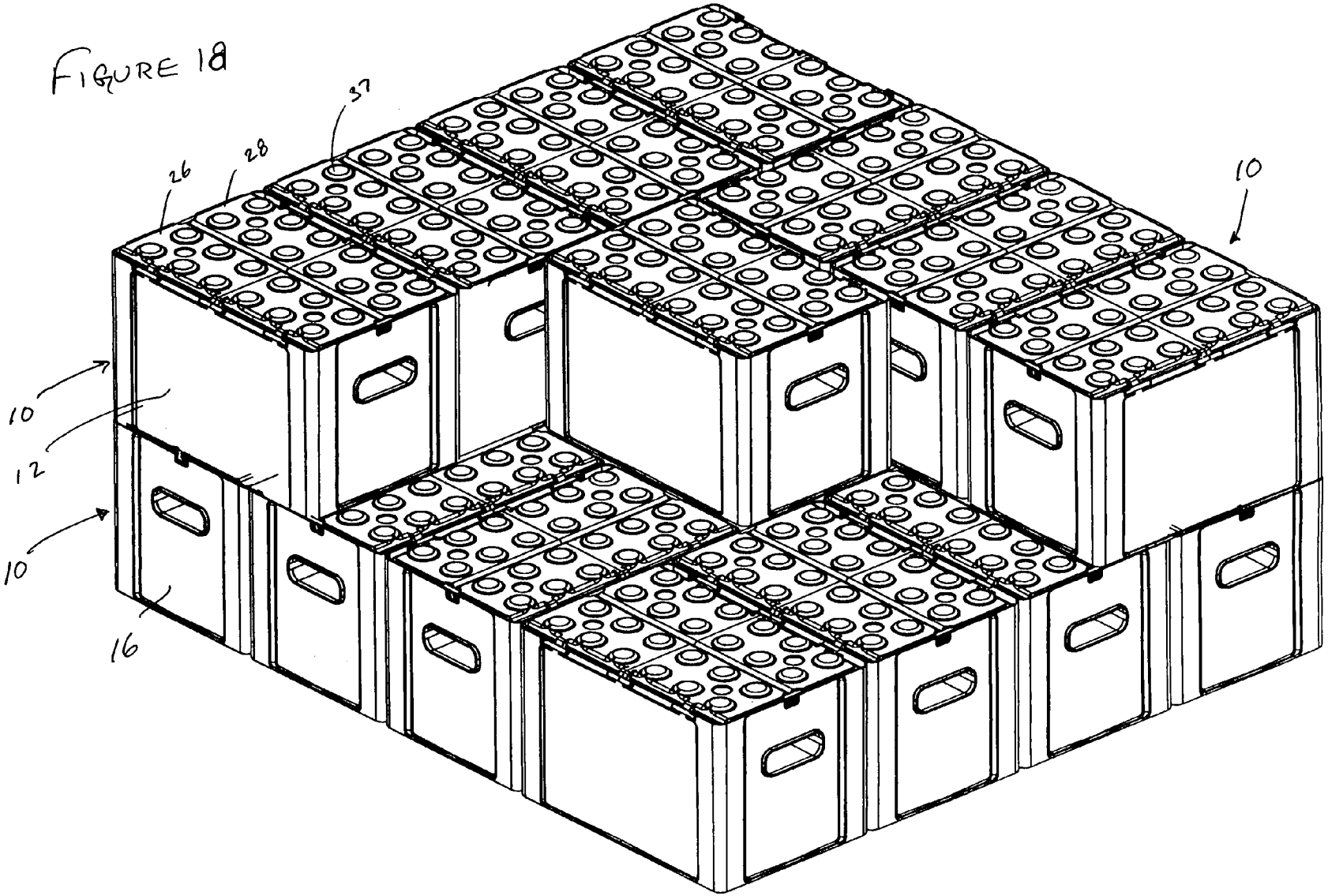
FIG. 18 is a perspective view showing a plurality of crates according to the present invention in a cross-stacked orientation.

It is noted from FIGS. 1, 7 and 8 that the lid capture areas 35 which are recesses in the bottom surface of lid portions 26, 28 define projections 37 in the upper surfaces 31, 33 of lid portions 26, 28 respectively. Accordingly, each lid capture area 35 receives a corresponding bottle top or cap 42 (or upper container portion for containers other than bottles) therein which serves to stabilize the bottles and minimize or make negligible the lateral or rotational movement of the bottles during storage and transport, thereby keeping the bottles vertically aligned. Such vertical alignment is particularly desirable when crate 10, having bottles stored therein, also has a similar crate 10' stacked or cross-stacked thereon as shown in FIGS. 17-18, respectively. Similar features of crate 10' are provided with a prime (') designation. Because bottles 38 positioned in such orientations receive and distribute the load of the crates stacked and cross-stacked thereon, the vertically aligned bottles receive and distribute this load better than those bottles which are not vertically aligned.

As illustrated in FIGS. 2, 5 and 9-12, compartment 30 in one embodiment includes divider members 44 for defining individual bottle retention areas 40. Divider members 44 are shown oriented perpendicular to each other and include longitudinal extending divider portions 46 and transverse extending divider portions 48. FIG. 9 is a cross-sectional view of a bottle 38 disposed within the bottle retention areas 40, and wherein the lid portions 16, 18 is in the closed position such that the cap 42 of bottle 38 is oriented within the lid capture area 35.

Figure 11:
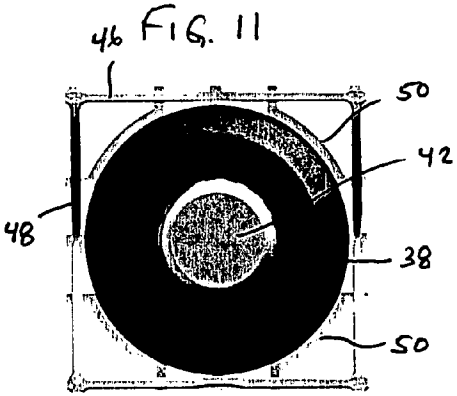
FIG.11 is a top plan view of a single bottle and bottle placement area within the container.
Figure 12:
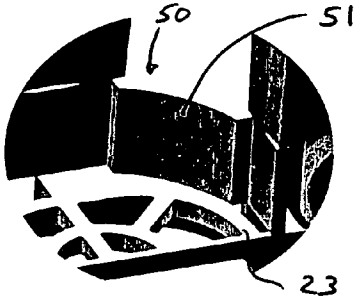
FIG. 12 is a close-up perspective view of a bottle standoff portion within the container.
Figure 20:
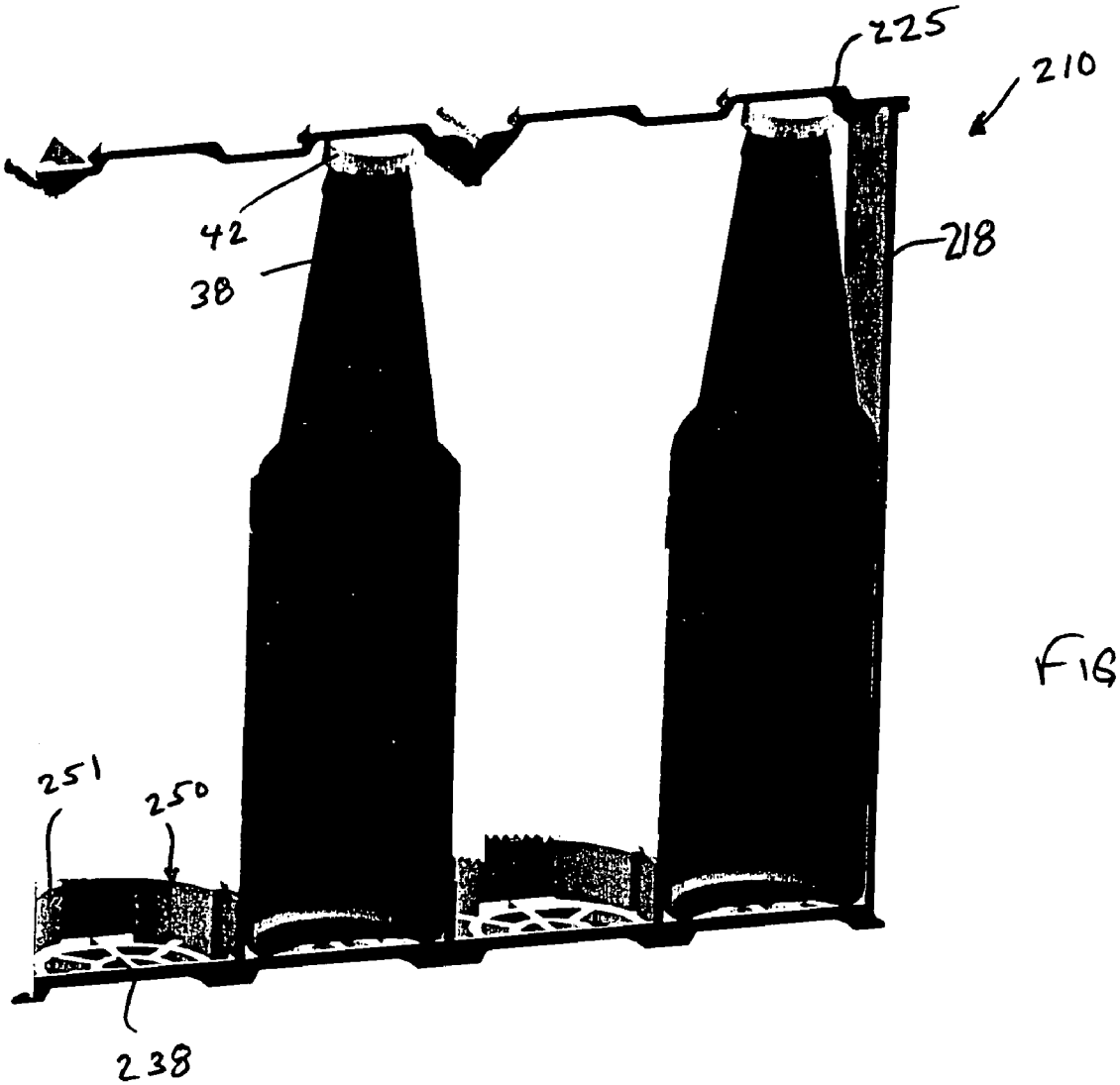
FIG. 20 is a view similar to FIG. 9, without divider members.

As shown in FIGS. 9 and 11-12, divider members 44 include at least one, and preferably a plurality of standoff members 50 (or spacer members) which project into each bottle retention area 40. As noted in FIG. 11, the crate illustrated herein includes four standoff portions 50 within each bottle retention area 40. The standoff portions 50 are illustrated as being disposed in the corners of the bottle retention areas 40, extending between adjacent divider members 46 and 48. In one embodiment, standoff portions 50 are shown as attached to divider members 44. However, as illustrated in FIG. 20, standoff portions 50 may also be attached to and project upwards from bottom panel 20, bordering support areas 23, without the use of associated divider members.

Standoff portions 54 are disposed at the four corners of crate 10, as shown in FIG. 5, and are attached to their respective adjacent side and end walls 12, 14 and 16, 18. Standoff portions 50 serve to keep bottle 38 vertically aligned within retention areas 40, in order to avoid lateral movement of the bottle. Thus, standoff portions 50 particularly assist in keeping the bottle centered within the bottle retention area 40 so that the bottle label which is attached, screened or otherwise placed onto the bottle is spaced apart from and kept away from the divider walls, which otherwise may cause rubbing, peeling, scratching, or other wear and damage to the bottle label or to the other container markings, such as print which is deposited thereon by a screening process. Of course, in a preferred embodiment, the standoff portions 50 and the lid capture area 35 proximate to each bottle 38 serve to keep the bottle 38 in an upright orientation and perpendicular to bottom panel 20, and thus maintain bottle 38 spaced apart from the divider walls 44 and/or side walls 16, 18, in order to prevent contact by the bottle therewith.

While standoff portions 50 may have any height feasible according to the teachings of the present invention, standoff portions 50 preferably have a relatively short height, such that they mate with and contact the container 38 at a bottom portion thereof, and below the label portion or the print portion typically disposed on a middle portion of the bottle or container, in keeping with the teachings according to the present invention. In the situation where the container is a glass or plastic bottle having a label (again either mounted or screened thereon), the standoff portion 50 mates with the glass or plastic portion of the container below the label. Each standoff portion 50 has a mating surface 51 for engaging the container 38. As illustrated in FIGS. 11-12, for container 38 having a cylindrical body portion, such mating surface 51 of standoff portion 50 is preferably contoured, having a curvature for mating with the container 38. While the height of the bottom edge of the standoff portion is contemplated to be dictated by the height of the corresponding bottle labeling (includes screening), it is noted that the height of standoff portion 50 is relatively short compared to the height of the divider members, the side walls, and the bottles themselves.

By way of example only and not limitation, a recent survey of twelve-ounce beverage bottles reflects the following bottle and label approximate measurements:

| Bottle Number | Bottle Height | Bottom of Bottle to Bottom Edge of Label |
|---|---|---|
| 1 | 9 inches | 1⅛ inches |
| 2 | 9½ inches | ⅞ inch |
| 3 | 9⅛ inches | 13/16 inch |
| 4 | 7⅝ inches | ⅞ inch |

Accordingly, the height of the standoff portions 50 for each bottle is preferably less than the corresponding bottle measurement for the "bottom of bottle to the bottom edge of label".

Again, standoff portions 50 keep the bottle from contacting the divider members and thus prevents rubbing against, peeling or other damage to the bottle label or to the other container markings. In keeping with the teachings of the present invention, standoff portion 50 should have a sufficiently low profile in order to achieve these same objectives. It is also contemplated that standoff portion 50 may be connected to each other to define an annular upstanding flange, thereby forming an area therein receiving the base of container 38 therein, and thus inhibiting contact between the container 38 and the divider members 38 and/or sidewalls 16, 18.

Figure 6:
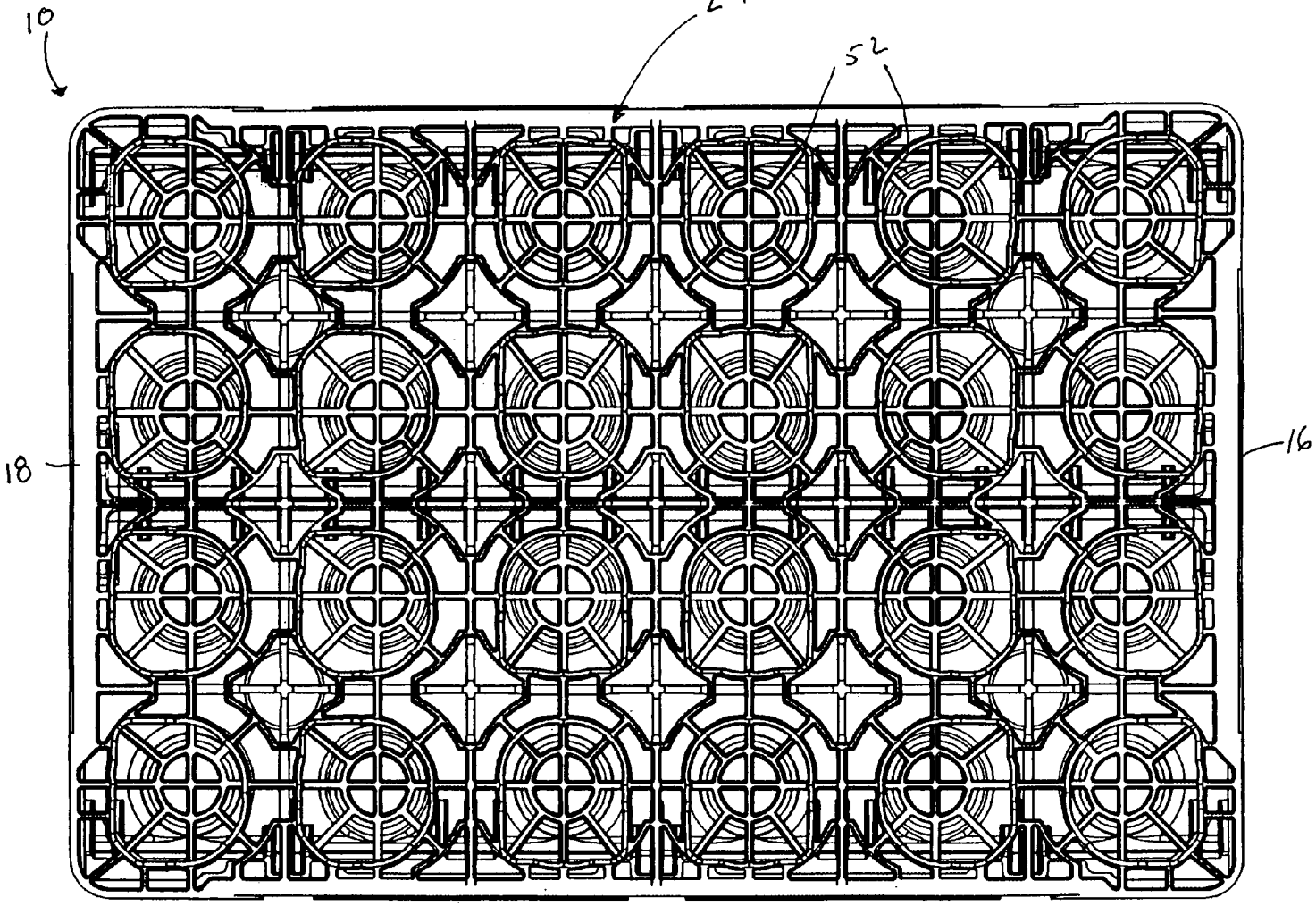
FIG. 6 is a bottom plan view of the container according to the present invention.

FIG. 6 illustrates a bottom plan view of crate 10 according to the present invention, and particularly illustrates the bottom surface 24 of bottom panel 20. With reference to FIGS. 3 and 6, bottom surface 24 of bottom panel 20 includes a plurality of projection receiving areas 52, which are particularly suited for receiving projections 37 formed on the upper surfaces 31, 33 of lid portions 26, 28, disposed or stacked therebelow. Thus, when two or more similar containers are in a stacked (FIG. 17) or cross-stacked orientation (FIG. 18), each bottom receiving portion 52 is defined by downstanding flanges which receive projections 37 therein, while allowing for some lateral movement of each container with respect to each other. This lateral movement is accommodated by the downstanding flange area which preferably does not exactly correspond to the shape of projections 37, but is somewhat offset in order to allow for movement and play of one container relative to another. Bottom surface 24 is generally shown as having a grid pattern having open areas disposed therein, such that water or other liquid may drain through the bottom surface, as well as providing for a more lightweight container.

As shown in the side elevational views of FIG. 8, end walls 16, 18 of crate 10 each have an opening formed therein to be used as a handle 56 by which a user may grasp and handle crate 10.

Figure 13:
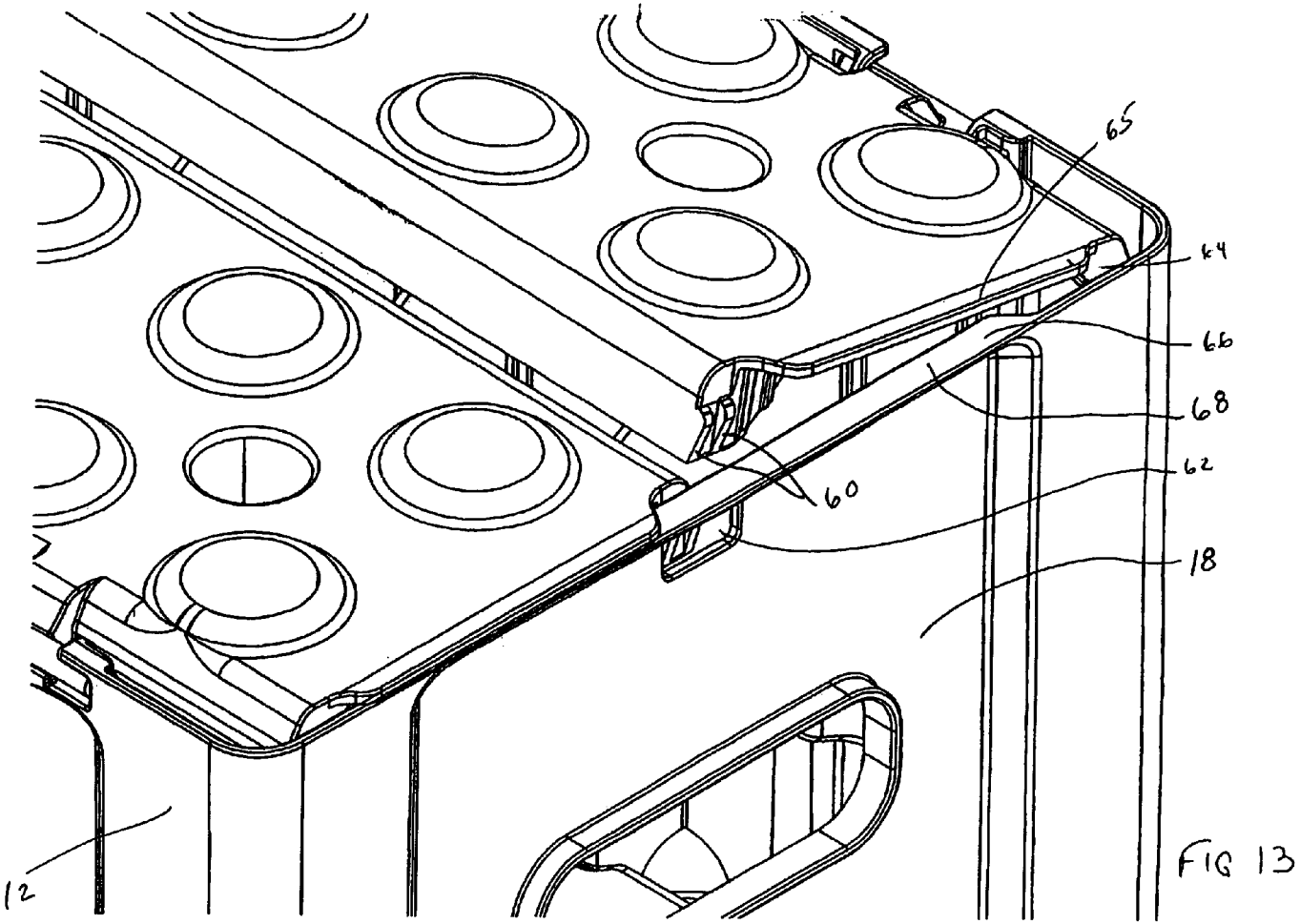
FIG. 13 is a partial perspective view of the container according to the present invention with one lid portion in a partial open position.
Figure 14:
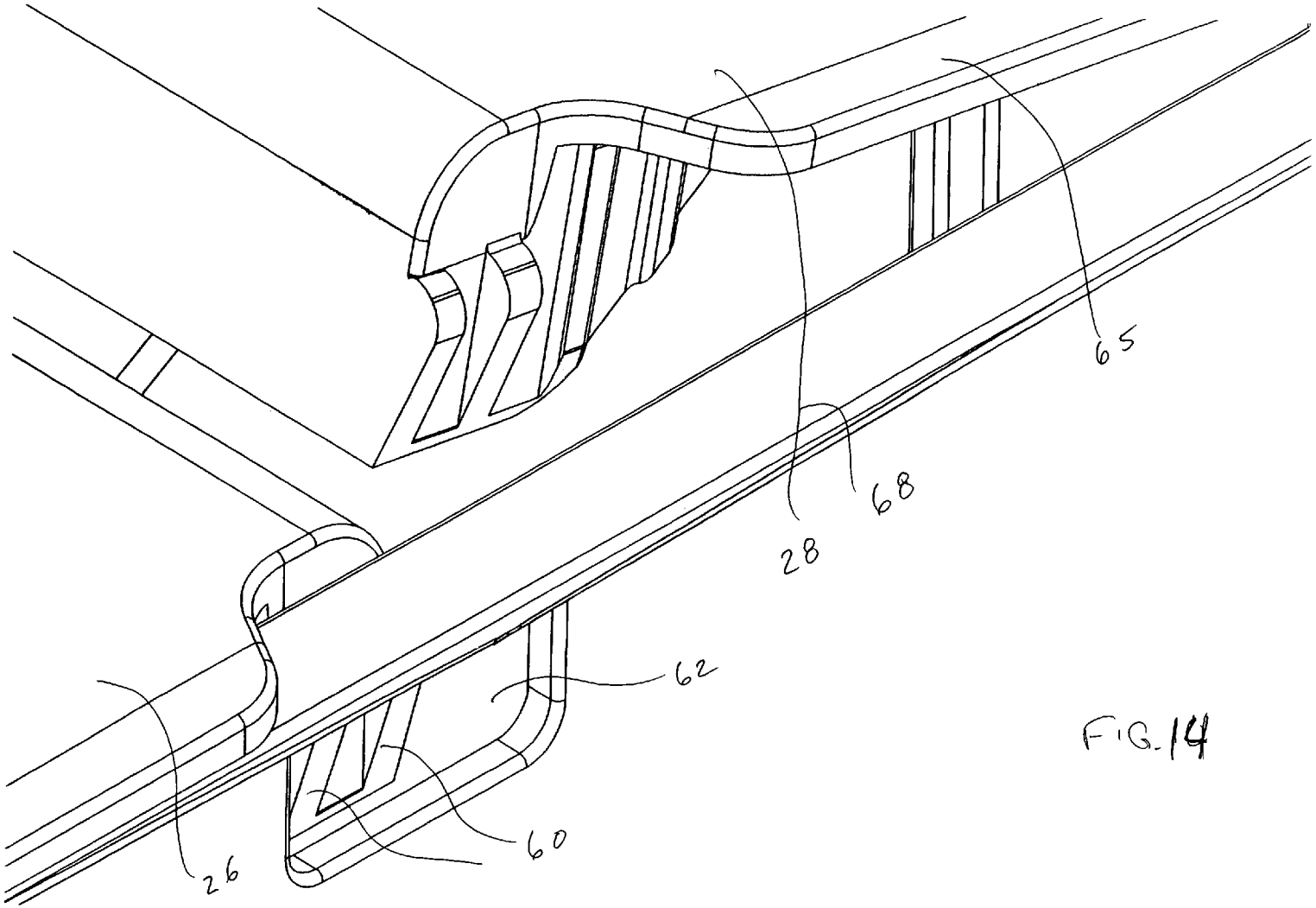
FIG. 14 is an enlarged view of the area in FIG. 13 which illustrates the partially open lid portion.

As illustrated in the enlarged perspective views of FIGS. 13 and 14, each lid portion 26, 28 has a pair of opposed edges 64, each having at least one and preferably two projections 60 (or tab members) which are received by a corresponding opening 62 formed in walls 16, 18 for securing the inward portions of the respective lid members 26, 28 to walls 16, 18. As illustrated in FIGS. 13-14, end walls 16, 18 have an upper edge 66 which defines opening 62, the upper edge 66 having a flanged central upper surface portion 68. Thus, when lid portions 26, 28 are in the closed position (FIG. 1), a flanged portion 65 of lid lateral edge 64 engages and mates with the flanged central upper surface portion 68 of walls 16, 18.

Figure 15:
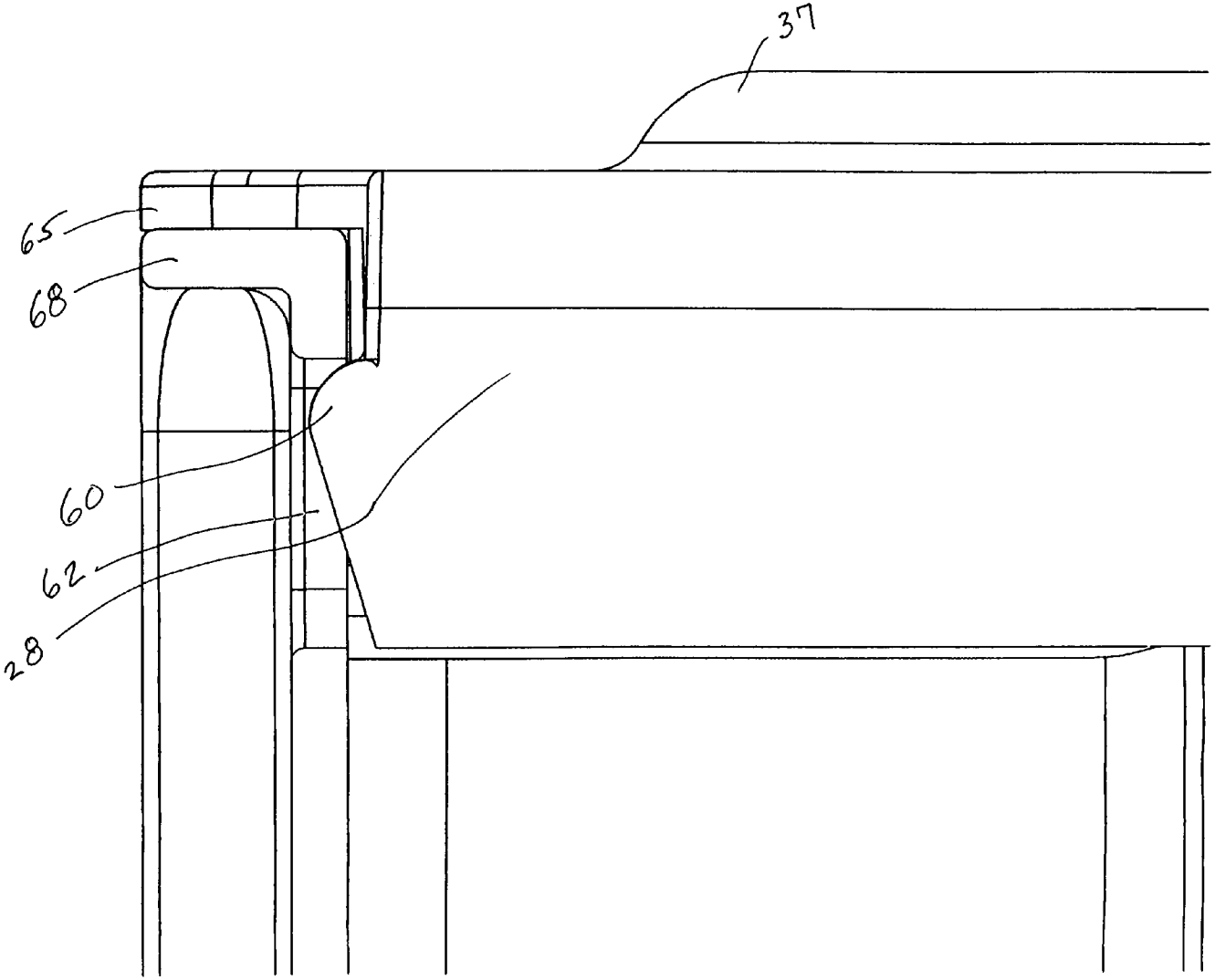
FIG. 15 is a partial cross-sectional view taken along the longitudinal centerline of the container shown in FIG. 1, with the lid in the closed position.

FIG. 15 is an enlarged, partial cross-sectional view taken along the longitudinal centerline of crate 10 where lid portions 26, 28 are disposed proximate each other when in the closed orientation. This view particularly illustrates the cooperation of the lid tab members 60 within opening 62, for securing the inward portions of lids members 26, 28 to walls 16, 18.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A crate for holding a beverage container having an outer surface with a lower portion and a central label area, the crate comprising:

a unitary bottom panel having an upper surface;

a first pair of opposed side walls and a second pair of opposed side walls attached to the periphery of the bottom panel to form a unitary construction therewith and defining a compartment area therein; and a divider assembly having a plurality of divider members attached to the upper surface of the bottom panel and extending longitudinally and transversely in the compartment area to define at least one container receiving area for receiving the beverage container therein, the divider assembly including a plurality of low profile standoff portions having a container contact surface spaced from corresponding divider members and generally transverse to the upper surface of the bottom panel, wherein the container contact surface of each standoff portion is concave, the standoff portions extending inwardly into the at least one container receiving area for engaging the lower portion of the container to provide stability thereto and for maintaining the corresponding beverage container in a spaced relationship from the divider members, wherein the standoff portions are shorter than the divider members and wherein the bottom panel, first and second pairs of opposed side walls and divider assembly are all integrally molded as one piece.

2. The crate of claim 1, wherein the standoff portions have a height corresponding to the height of the container lower portion.

3. The crate of claim 1, wherein the standoff portions have a relatively low profile such that a bottle is contacted below the central label area.

4. The crate of claim 1, further comprising a lid member pivotably attached to at least one of the first and second pair of opposed side walls, the lid member having a lid inner surface with a lid capture area formed therein corresponding to the at least one container receiving area, the lid capture area sized to receive an upper portion of a respective container for providing alignment to the container.

5. The crate of claim 1, wherein the bottom panel has a bottom surface with a plurality of projection receiving areas formed therein.

6. The crate of claim 5, further comprising at least one lid member pivotably attached to at least one of the first and second pair of opposed side walls, the at least one lid member orientable between a closed position and an open position, the lid member having an outer surface with a plurality of projections extending therefrom, wherein when the lid of the crate is in the closed position and a second crate is stacked thereupon, the projections of the lid member are received within a corresponding projection receiving areas of the second crate for providing a more stable stacking configuration.

7. The crate of claim 1, wherein the standoff portions have a height relatively shorter than the corresponding divider members.

8. The crate of claim 1, wherein the at least one container receiving area has four standoff portions extending therein for engaging the container.

9. The crate of claim 1, wherein the standoff portions engage the bottom panel.

10. The crate of claim 1 wherein the divider members are generally planar and wherein intersections of the divider members form corners in the container receiving areas, the plurality of standoff portions each extending from a longitudinally-extending one of the divider members to a transversely-extending one of the divider members in the corners.

11. The crate of claim 10 wherein the plurality of standoff portions protrude upwardly from the upper surface of the bottom panel and protrude inwardly toward the container from the divider members.

12. The crate of claim 1 wherein the standoff portions are relatively shorter than the divider members.

13. The crate of claim 1 wherein the container contact surface of each standoff portion is concave when not in contact with the beverage container.

14. The crate of claim 13 wherein the standoff portions each have a height less than 1⅛ inches.

15. The crate of claim 14 wherein the standoff portions each have a height less than ⅞ inch.

16. A crate for retaining containers having an outer surface with an upper container portion and a lower container portion, the crate comprising:

a unitary floor having a periphery and an upper surface with a plurality of container support areas;

a first and second pair of opposed sidewalls extending upwardly from the floor periphery forming a unitary construction therewith and defining a compartment area;

a lid member having a first hinge portion pivotably attached to a second hinge portion of at least one of the first and second pair of opposed side walls and movable between an open and closed position, the lid member having a lid inner surface having a lid capture area formed therein corresponding to a respective one of the container support areas, the lid capture area sized to receive therein the upper container portion of a respective one of the containers for providing alignment to the container;

a plurality of divider members extending within the compartment and projecting upwardly from the floor to define container receiving areas, wherein the floor, first and second pairs of opposed side walls and divider members are all integrally molded as one piece; and a plurality of low profile spacer members disposed proximate the floor and spaced inwardly from the divider members into corresponding container receiving areas such that the container support areas and spacer members define pockets for receiving the lower container portion, the spacer members contacting the containers and spacing the containers from the divider members and the sidewalls.

17. The crate of claim 16, wherein at least one of the sidewalls has a lock receiver formed therein, and the lid member has at least one locking member attached thereto, such that when the lid member is in the closed position, the locking member is received within the lock receiver for securing the lid member thereto.

18. The create of claim 16, wherein the floor has a bottom surface with a plurality of receiving areas formed therein.

19. The crate of claim 16, wherein the lid member has an outer surface with a projection member extending therefrom corresponding to each lid capture area, wherein when the lid member is in the closed position and a second crate is stacked thereupon, at least some of the projections on the outer surface of the lid member is received within a corresponding projection receiving area of the second crate for providing a more stable stacking configuration.

20. A crate for holding a beverage container having a lower portion and a central label area, the crate comprising:

a bottom panel having an upper surface;

a first pair of opposed side walls and a second pair of opposed side walls attached to the periphery of the bottom panel to form a unitary construction therewith and defining a compartment area therein; and a divider assembly having a plurality of divider members attached to the upper surface of the bottom panel and extending longitudinally and transversely in the compartment area to define at least one container receiving area for receiving the beverage container therein, the divider assembly including a plurality of standoff portions shorter than the divider members, wherein the standoff portions protrude upwardly from the upper surface of the bottom panel, each standoff portion having a container contact surface spaced from corresponding divider members and generally transverse to the upper surface of the bottom panel, the standoff portions protruding inwardly toward the container from the divider members for engaging the lower portion of the container without contacting the central label area to provide stability to the container and for maintaining the corresponding beverage container in a spaced relationship from the divider members.

21. A crate holding a beverage container, the crate comprising:

a unitary bottom panel having an upper surface;

a first pair of opposed side walls and a second pair of opposed side walls attached to a periphery of the bottom panel to form a unitary construction therewith and defining a compartment area therein;

a divider assembly having a plurality of divider members attached to the upper surface of the bottom panel and extending longitudinally and transversely in the compartment area to define at least one container receiving area for receiving the beverage container therein, the beverage container having a lower portion and a central label area, the beverage container in the at least one container receiving area, the divider assembly including a plurality of low profile standoff portions having a container contact surface spaced from corresponding divider members and generally transverse to the upper surface of the bottom panel, the standoff portions extending inwardly into the at least one container receiving area for engaging the lower portion of the beverage container to provide stability thereto and for maintaining the corresponding beverage container in a spaced relationship from the divider members, wherein the standoff portions are shorter than the divider members and wherein the bottom panel, first and second pairs of opposed side walls and divider assembly are all integrally molded as one piece and wherein the standoff portions each have a height less than a height of the lower portion of the beverage container below the central label area such that the standoff portions contact the lower portion of the beverage container without contacting the central label area.

* * * * *